US007891150B2

(12) United States Patent
Finfrock et al.

(10) Patent No.: US 7,891,150 B2
(45) Date of Patent: Feb. 22, 2011

(54) COMPOSITE TRUSS

(75) Inventors: Robert D. Finfrock, Orlando, FL (US); Allen R. Finfrock, Maitland, FL (US)

(73) Assignee: Finfrock Industries, Inc., Apopka, FL (US)

( * ) Notice: Subject to any disclaimer, the term of this patent is extended or adjusted under 35 U.S.C. 154(b) by 615 days.

(21) Appl. No.: 11/626,629

(22) Filed: Jan. 24, 2007

(65) Prior Publication Data

US 2007/0193185 A1 Aug. 23, 2007

Related U.S. Application Data

(60) Provisional application No. 60/762,080, filed on Jan. 25, 2006.

(51) Int. Cl.
*E04B 1/18* (2006.01)
*E04B 1/22* (2006.01)

(52) U.S. Cl. ..... 52/414; 52/790.1

(58) Field of Classification Search ..... 52/414, 52/426, 431–433, 783.1, 790.1, 690, 693, 52/479, 442, 565, 378, 428, 649.1, 649.8
See application file for complete search history.

(56) References Cited

U.S. PATENT DOCUMENTS 1,102,991 A * 7/1914 McKennee ..... 52/428
2,088,645 A * 8/1937 Fling ..... 52/565
2,940,295 A * 6/1960 Post ..... 52/204.1
3,347,007 A * 10/1967 Hale ..... 52/380
4,133,156 A * 1/1979 Unger ..... 52/383
4,236,364 A * 12/1980 Larsson et al. ..... 52/383
4,348,848 A * 9/1982 Denzer ..... 52/432
4,418,463 A * 12/1983 McNeill ..... 29/527.4
4,885,888 A * 12/1989 Young ..... 52/426
5,398,470 A * 3/1995 Ritter et al. ..... 52/309.11
6,003,281 A * 12/1999 Pilakoutas ..... 52/742.14
6,070,380 A * 6/2000 Meilleur ..... 52/309.7
6,167,671 B1 * 1/2001 Wilson ..... 52/654.1
6,536,172 B1 * 3/2003 Amend ..... 52/426
7,073,300 B1 * 7/2006 Sohns ..... 52/426
2003/0029107 A1 * 2/2003 Ritter et al. ..... 52/309.11
2003/0136071 A1 * 7/2003 Kobayashi ..... 52/414
2004/0020149 A1 * 2/2004 Messiqua ..... 52/426

* cited by examiner

*Primary Examiner*—Khoi Tran
*Assistant Examiner*—Jason Holloway
(74) *Attorney, Agent, or Firm*—Terry M. Sanks; Beusse Wolter Sanks Mora & Maire, P.A.

(57) ABSTRACT

A composite truss includes a pair of spaced apart concrete panels and a plurality of substantially vertical members spanning between the pair of spaced apart concrete panels, a first end portion of each vertical member embedded in one of the pair, and a second end portion of each vertical member embedded in an opposite one of the pair. The truss also includes a diagonal member spanning between the first end of a first vertical member and the second end of a second vertical member linearly adjacent to the first vertical member and non-structurally engaging the first end portion of the first vertical member and the second end portion of the second vertical member during an assembly of the truss. The diagonal member also includes a first development length portion embedded in the first concrete panel and a second development length portion embedded in the second concrete panel.

20 Claims, 6 Drawing Sheets

COMPOSITE TRUSS

CROSS REFERENCE TO RELATED APPLICATIONS

This application claims priority from U.S. Provisional Application No. 60/762,080, filed on Jan. 25, 2006.

FIELD OF THE INVENTION

The present invention relates to a precast and/or prestressed concrete and steel composite structural member for use in construction.

BACKGROUND OF THE INVENTION

Prefabricated, double wall concrete components have been used in the past to construct building walls. Such wall members may include a plurality of welded wire spacing frames to retain the slabs of the wall member in a spaced apart configuration. Typically, the welded wire spacing frames provide limited structural reinforcement of the wall member. It has been proposed to use such prefabricated wall members as structural flooring and/or roofing members. However, a dual slab member designed as a wall may not be readily adaptable to a floor or roofing application due to different loading forces on the member. For example, a wall member used in a floor application may have a limited span distance due to the minimum structural capacity provided by the welded wire spacing frames.

More robust welded steel trusses having upper and lower longitudinal portions embedded in respective upper and lower slabs have been proposed as a framing structure for a composite truss that can span up to around 60 feet. However, welding and/or other structural attachment techniques used to manufacture such framing structures significantly adds to the cost and time needed to manufacture the trusses and thereby increases the cost of the composite truss.

BRIEF DESCRIPTION OF THE DRAWINGS

The features of the invention believed to be novel are specifically set forth in the appended claims. The features and advantages of the present invention will become apparent from the following detailed description of the invention when read with the accompanying drawings in which:

DETAILED DESCRIPTION OF THE INVENTION

The inventors of the present invention have realized that by using non-structurally attached frames for a composite truss, considerable cost savings may be realized by avoiding the need to weld and/or otherwise structurally attach individual elements of the frame. Furthermore, strength of the composite truss may be maintained or even enhanced without structurally attaching the frame members together by innovatively including a development length portion of diagonal members of the frame for embedment in concrete panels of the composite truss.

Figure 1:
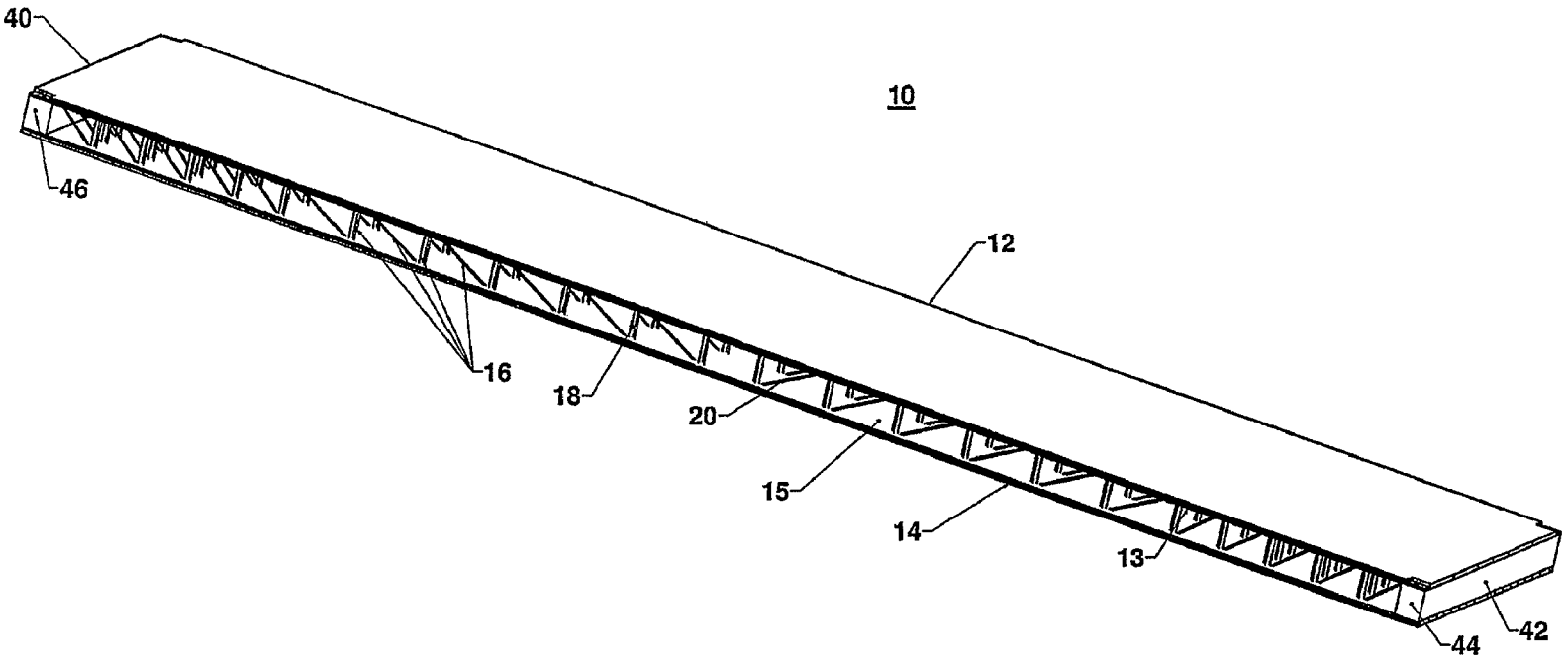
FIG. 1 is a perspective view of an example embodiment of a composite truss.
Figure 2:
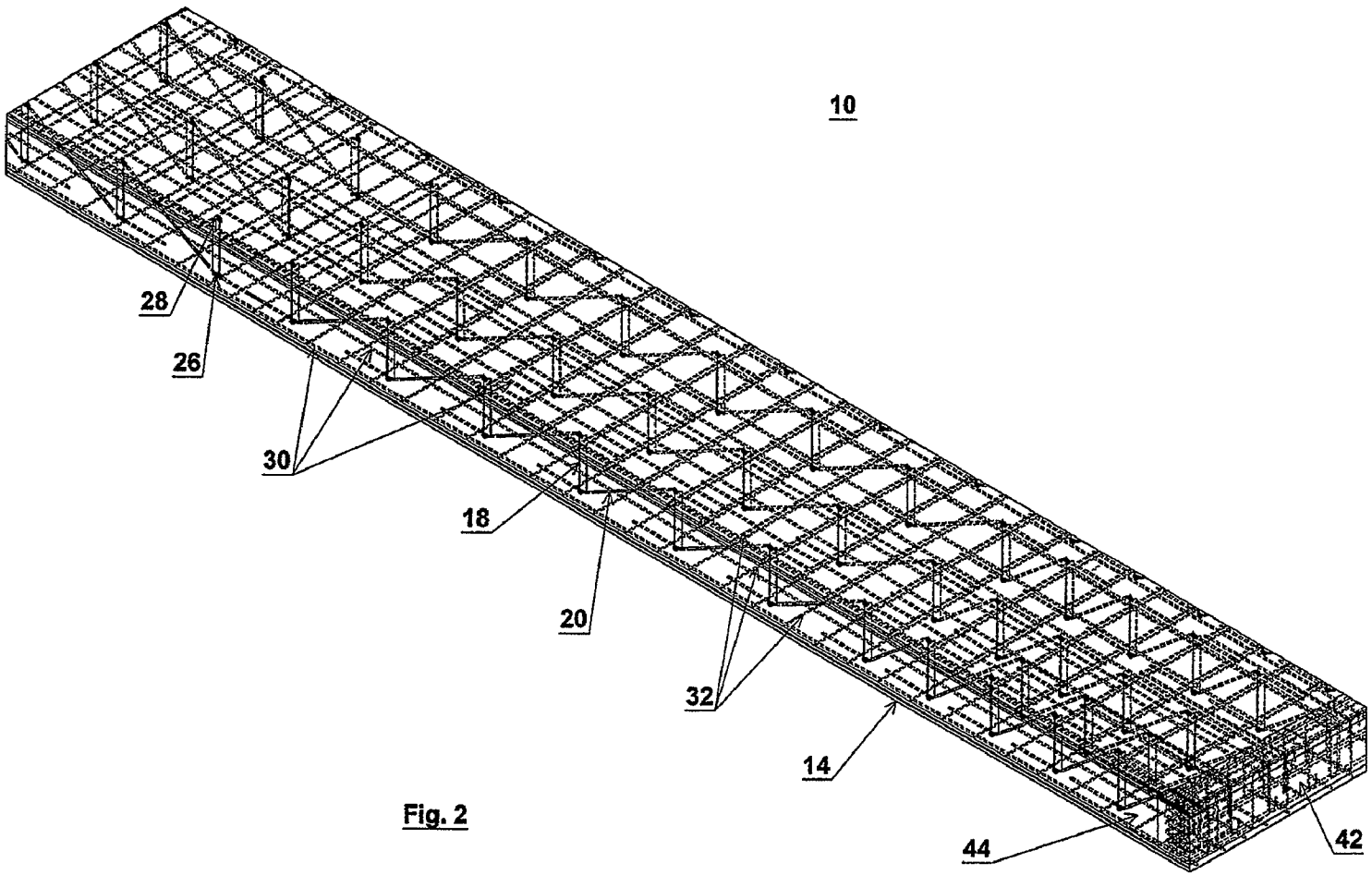
FIG. 2 is a transparent perspective view of the composite truss of FIG. 1 showing a framing structure of the truss.

FIG. 1 shows a perspective view of an example embodiment of a composite truss 10 and FIG. 2 shows a transparent perspective view of the example composite truss of FIG. 1 showing a framing structure of the truss. The composite truss 10 comprises a pair of spaced apart concrete panels including an concrete upper panel 12 and a concrete lower panel 14. In an example embodiment, each panel 12, 14 may have a dimension of about 12 feet wide by about 60 feet long and about 2.5 inches thick. Other dimensions may be utilized depending upon the particular application. The composite truss 10 described with the above dimensions is of a type that may typically be used as a horizontal structural member for use in construction.

Each of the upper panel 12 and lower panel 14 are joined together by a framing structure including a plurality of frames 16 that are non-structurally attached during assembly of the truss 10. The frames 16 fix the upper panel 12 to the lower panel 14 and provide a structural strength to allow the member 10 to be used in the position shown in FIG. 1 as a horizontal structural member. The non-structurally attached frames 16 may be formed from a plurality of diagonal members 20 and vertical members 18 more clearly shown in FIG. 2. The frames 16 may be preassembled on a jig and attached to each other using a nonstructural attachment technique, such as a press fit or friction fit. For example, the vertical members 18 may include in their respective end portions 22, 24 slots 26, 28 configured for receiving a portion of the diagonal members 20 therein in a press fit or frictional fit arrangement sufficient for allowing the frame 16 to be removed from the jig and transported as one unit to another location. As used herein, vertical is used merely for convenience in describing the vertical members 18 extending substantially perpendicularly between respective faces 13, 15 of the upper 12 and lower panel 14 as shown in FIG. 2 when the truss is used as horizontal structural member. For example, it is envisioned that the composite truss 10 could be oriented to be used as a vertical wall structure member in which the vertical member 18 would be oriented in a substantially horizontal direction.

The composite truss 10 may also include longitudinal reinforcing strands 30 extending lengthwise in one, or both, of the panels 12, 14. The longitudinal reinforcing strands 30 may provide for pre-tensioning and/or post-tensioning of the composite truss 10. The composite truss 10 may also include a plurality of lateral reinforcing bars 32 extending cross-wise in one, or both, of the panels 12, 14. The lateral reinforcing bars 32 and/or the longitudinal reinforcing bars 30 may be used as supports for the frames 16 during manufacture of the composite truss. For example, one or more diagonal members 20 may be wired to a lateral reinforcing bar 32 and/or a longitudinal reinforcing bar 30 to hold the frame 16 in a desired position during a concrete pouring step of truss 10 manufacture.

Figure 3:
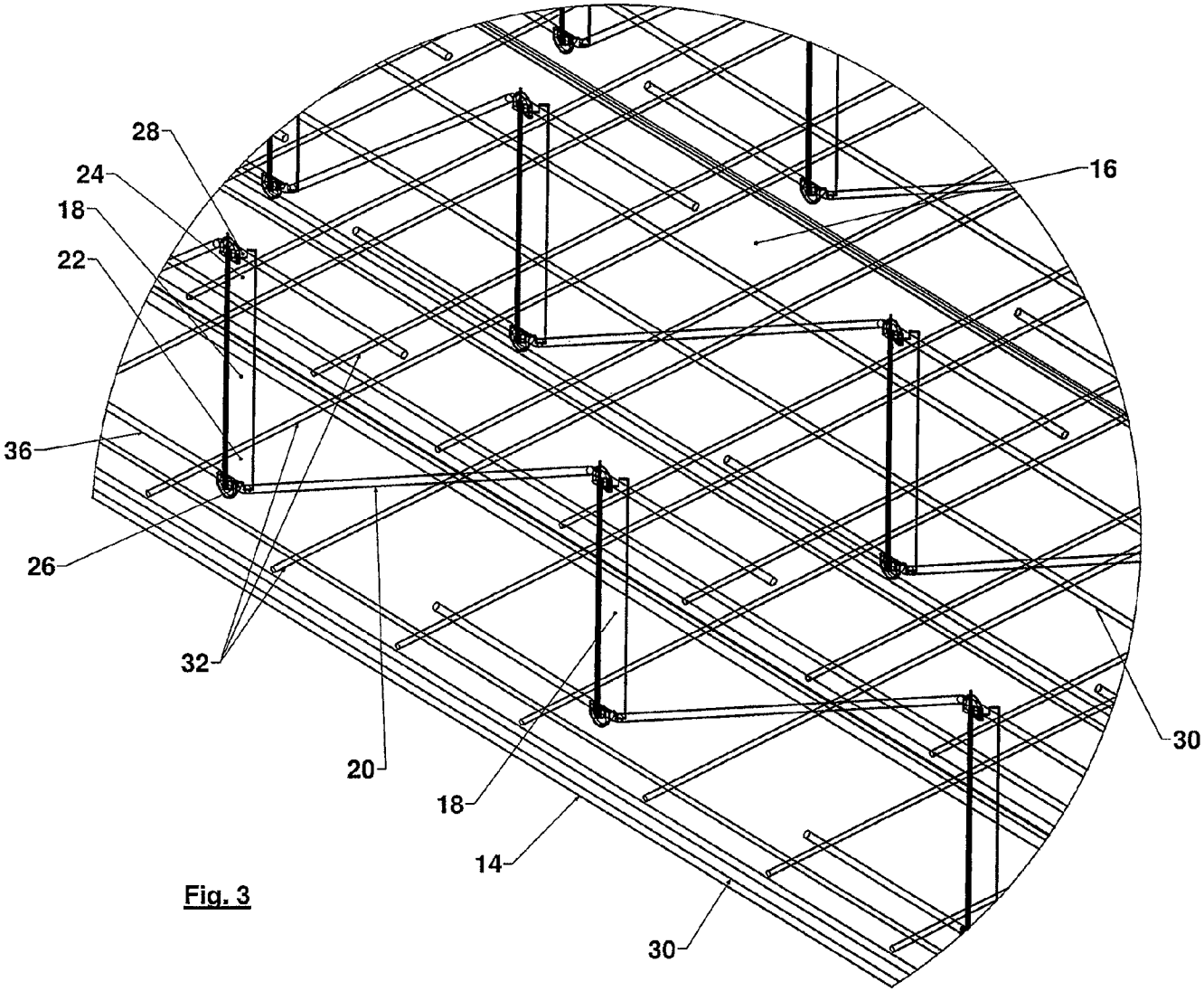
FIG. 3 is a partial cutaway portion of the composite truss of FIG. 1 showing details of vertical and diagonal members of the framing structure.
Figure 6:
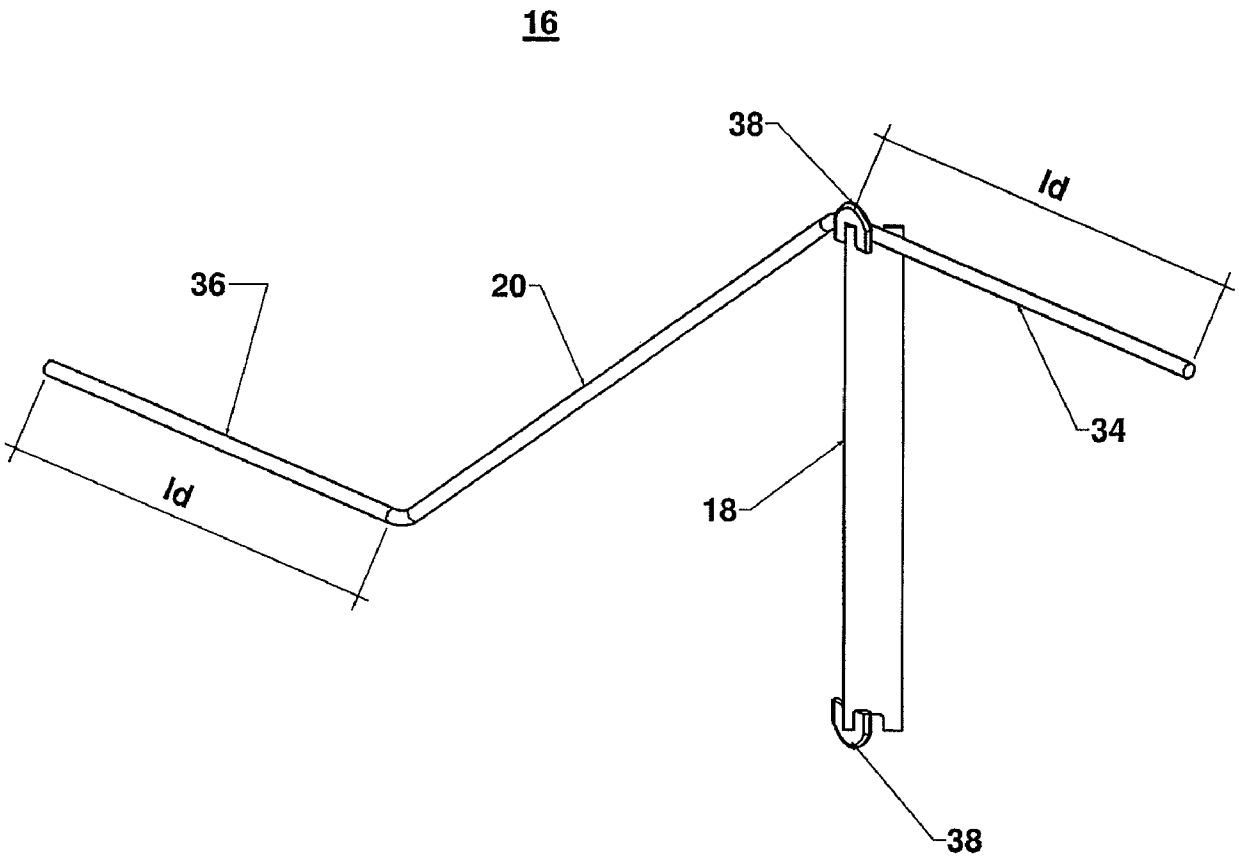
FIG. 6 is a perspective view of a diagonal member fitted to a vertical member as illustrated in FIGS. 2 and 3.

In an aspect of the invention depicted in FIGS. 2, 3, and 6, the diagonal member 20 may be geometrically configured to include a diagonal portion 21 configured for diagonally spanning from one end portion 22 of a vertical member 18 to an opposite end portion 24 of an adjacent vertical member between the panels 12, 14. In an example embodiment, the diagonal members 20 may be formed from concrete reinforcing bars (rebar) and may include a desired development length $l_d$ for embedment in both of the panels 12, 14 to establish a tension connection between the panels 12, 14. For example, the diagonal member 20 may include a first end portion 34 for embedment in the upper panel 12 and a second end portion 36 for embedment in the lower panel 14. The development length $l_d$ may be established using about a 90 degree bend in respective end portions 34, 36 as show in FIGS. 3 and 6, or by using other methods according to American Concrete Institute (ACI) standards, such as a straight run or 180 degree bend. By providing a development length ld for embedment in the panels 12, 14, a need for structural attachment of the vertical members 18 to the diagonal members 20 may be reduced, while advantageously retaining a desired structural strength of the composite truss 10.

Figure 4:
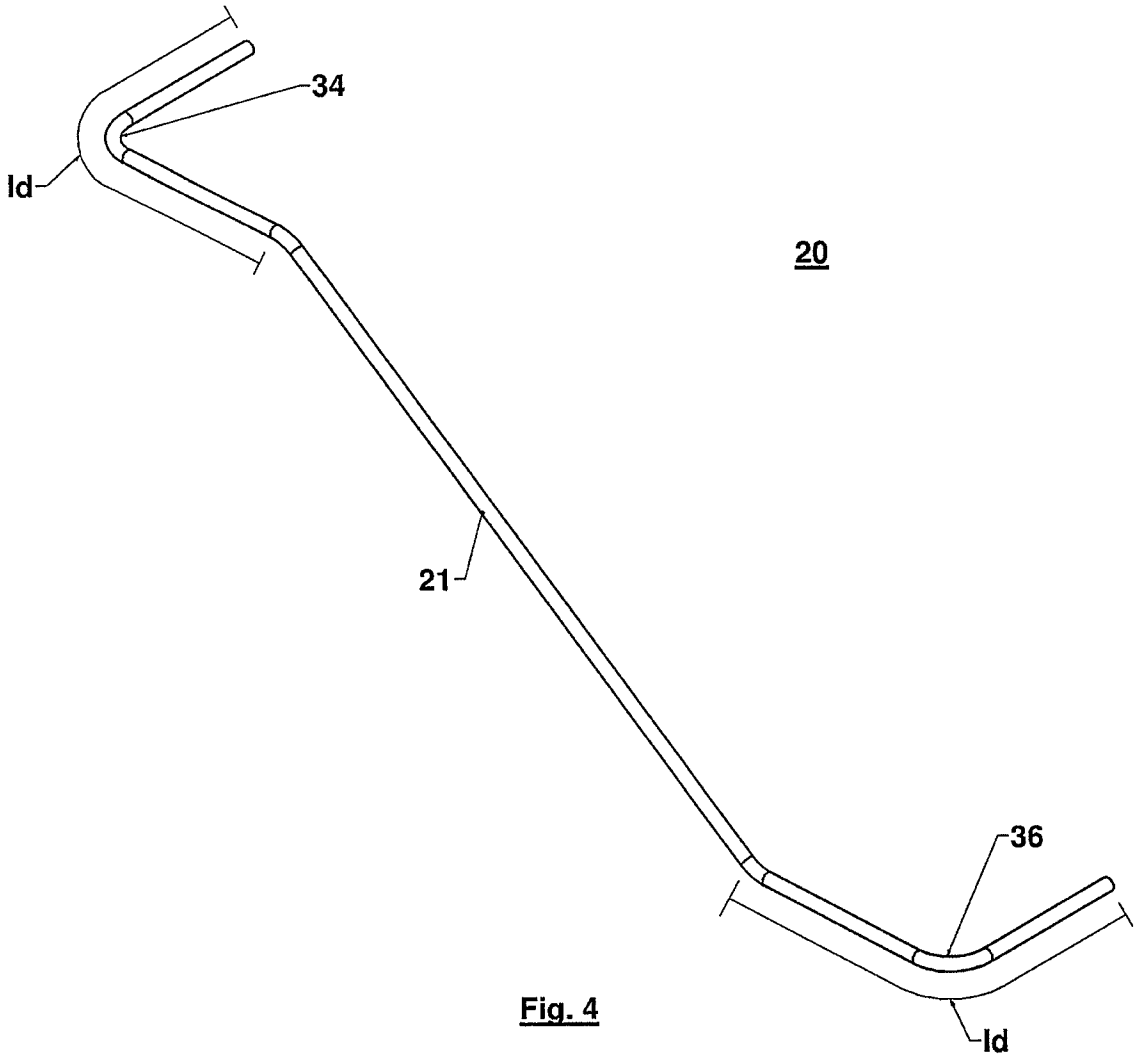
FIG. 4 is a perspective view of an example embodiment of a diagonal member of the framing structure of the composite truss.
Figure 5:
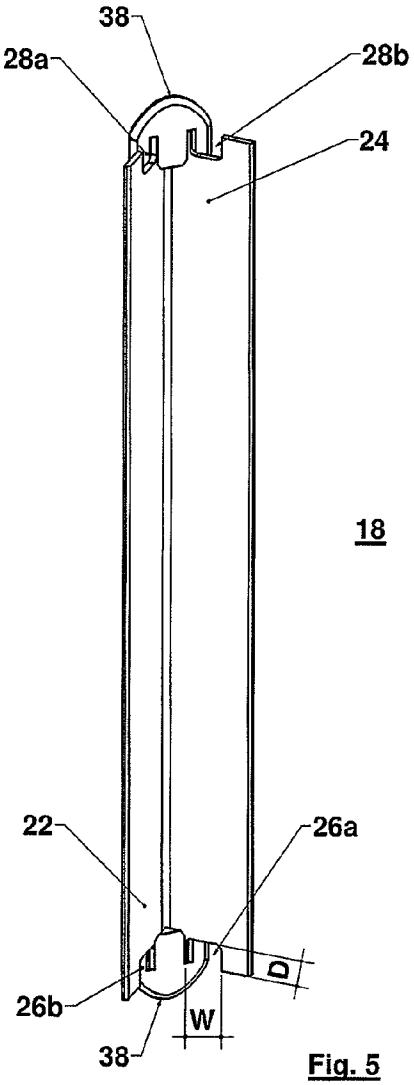
FIG. 5 is a perspective view of an example embodiment of a vertical member of the framing structure of the composite truss.

In another embodiment of the invention depicted in FIGS. 2, 4, and 6, the vertical members 18 may include formed metal members, such as formed steel members. The vertical members 18 may include an "L" cross section, i.e, an angle, or another geometric configuration having a desired structural cross section, such as a "T" cross section, an "I" cross section, a box cross section or a circular cross section. As shown in the angle embodiment of FIGS. 2 and 4, the end portions 22, 24 may include slots 26, 28 for receiving portions of the diagonal members 20 therein to form a press fit or frictional fit. The slots 26, 28 may be geometrically configured according to a size of rebar used for the diagonal members 20. For example, a slot width W of 0.57 inches and a slot depth of 0.375 inches may be used to provide a press fit or frictional fit for #3 rebar, and a slot width W of 0.75 inches and a slot depth D of 0.5 inches may be used to provide a press fit or frictional fit for #4 rebar. In an angle embodiment, each side of the angle may include a slot 28*a* arranged in relation with a corresponding slot 28*b* on the other side of the angle at an end portion 24 so that an appropriately sized rebar may be extended though both slots 28*a*, 28*b* as shown in FIG. 2. In another example embodiment, a spacer 38, such as a pin or chair, may be attached to one or both the end portions 22, 24 of the vertical member 18 to space the end portions 22, 24 away from a bottom of a form used to cast a concrete panel. In an angle embodiment, the spacer 38 may include a pin attached to an inside corner of the angle and extending away from the end portion 24.

In another example embodiment depicted in FIG. 1, the composite truss 10 may include prefabricated concrete end bearing beams 44, 46 transversely disposed at respective ends 40, 42 of the truss 10. The end bearing beams 44, 46 may include protruding elements, such as rebar ends, for embedment in one or more of the panels 12, 14 during manufacture of the composite truss 10. The end bearing beams 44, 46 allow the truss 10 to be supported at respective truss ends 40, 42 anywhere along the end bearing beams 44, 46. In an aspect of the invention, the end bearing beams 44, 46 act as forms, or headers, to retain concrete during a concrete forming process. In another aspect, the end bearing beams 44, 46 allow stacking of the trusses 10 during storage and transportation. In another example embodiment, the beams 44, 46 may be formed by filling respective ends 40, 42 of the composite truss 10 with concrete during manufacture.

Referring again to FIG. 1, the composite truss 10 created by the upper and lower panels 12 and 14 and the adjoining frames 16 are formed in two separate concrete pouring steps. In a first step, the upper panel 12 is poured into a steel mold as conventional wet concrete. The steel mold (not shown) is a conventional mold for pouring concrete and may have a smooth or other pre-formed surface on the inside that will transfer to the concrete poured into the mold. This allows the face of the panel 12 to be formed as either a very smooth finished surface or to be other pre-finished configurations on the surface. The pre assembled frame(s) is then inserted into the wet concrete in the mold or placed in the mold before the concrete is poured. At this point, the panel 12 is in an upside down configuration with the metal sticking upwards out of the panel 12. The frames 16 and panel 12 may then be inverted in preparation for assembly with the lower panel 14. For example, the frames 16 and panel 12 may be mechanically affixed in that mold and the mold, with the frames 16 and panel 12 retained therein, may be picked up and inverted for placement in a lower panel 14 mold pre-filled with wet concrete. In another example method, the 16 and panel 12 may be removed from the mold with conventional lifting equipment or with vacuum assisted equipment and then inverted for placement in a lower panel mold pre-filled with wet concrete. Using one of the above described methods for handling the upper panel 12, the upper panel is positioned over the wet concrete of lower panel 14 so that the ends of the reinforcing bar sink into the wet concrete. The concrete is typically shaken or vibrated to remove all air bubbles and to make sure that there is good contact between the mold, the reinforcing bars and the concrete. After the concrete panels 12, 14 are cured, the vertical 18 and diagonal 20 members become structurally attached via embedment in the respective cured concrete.

For both the upper and lower panels 12 and 14, the pins 38 of the vertical members 18 may be covered with a plastic cap before insertion into the wet concrete of the slabs so that if the ends of the bars are not fully coated by concrete, the plastic will be visible and not the metal of the rebar. This prevents oxidation of exposed rebar and rust stains being formed on the slab surfaces. Typically, the plastic inserts placed over the ends of the vertical members 18 have rounded end surfaces so that the exposed portions are limited to small areas.

An example application of the composite truss would be as a horizontal structural member for use in construction. Some example construction applications may include spanning floor or roofs in multi-floor commercial and or residential building applications. Spans for these applications generally may fall between about 35 to about 65 feet in length. Typically, precast/prestressed concrete structural members such as columns, beams and wall panels support the composite trusses and complete the building envelope. Some installation of utility components such as conduits, pipes and ducts can be installed in the factory with final hook up to completing components occurring at the jobsite. The dimensional accuracy of the floor and ceiling surfaces of the composite truss require no additional preparation and are ready to receive final surface treatments such as carpet, tile, paint or surface texture. All of these features result in a faster building schedule producing lower costs and less risk to all participants in the construction process.

Another example of a floor application would be in the use of the composite truss for finished floors of parking garages. Currently precast/prestressed concrete double tees or cast in place post-tensioned concrete are used in this application. Span lengths of approximately 60 feet are typical in this type of construction. Existing product depths of from 28" to 36" are typically required for the loading requirements at this span length. With the same superimposed live load of from 40 to 50 pounds per square foot the composite truss needs a depth of only 18 inches. This saves on building height with resultant lowering in cost of other components and possibly being better able to meet governmental mandated building height requirements. In addition, incorporation of utilities such as lighting, sprinkler pipes and electrical conduits produce a cleaner and more pleasant appearance. The flat ceiling results in better lighting distribution and therefore a possible reduction in lighting fixtures and operating costs. The flat ceiling results in an overall aesthetically pleasing and less confining feeling in the garage. The extremely flat top surface of the product will result in an excellent driving and walking surface unobtainable by any other means.

The materials used in the composite truss are not unlike those used in other structural precast/prestressed concrete products. Prestressed concrete strand, reinforcing bars and structural steel shapes along with high strength structural concrete, either normal or light weight, are the materials that are used in the composite truss just as are used in other structural concrete products.

While certain embodiments of the present invention have been shown and described herein, such embodiments are provided by way of example only. Numerous variations, changes and substitutions will occur to those of skill in the art without departing from the invention herein. For example, the composite truss may be used in sloped configurations angled away from horizontal, such as in a roof or a ramp application. Furthermore, the composite truss described herein may be used as a substantially vertical structural member, such as a wall. Accordingly, it is intended that the invention be limited only by the spirit and scope of the appended claims.

What is claimed is:

1. A composite truss comprising:

a pair of spaced apart precast/prestressed concrete panels;

a plurality of substantially vertical members spanning between the pair of spaced apart concrete panels and being substantially exposed between the pair of spaced apart concrete panels, with a first end portion of each vertical member embedded in one of the pair, and a second end portion of each vertical member embedded in an opposite one of the pair; and a plurality of diagonal members, each individual member being a continuous member, having a diagonal portion spanning between the first end of a first vertical member and the second end of a second vertical member linearly adjacent to the first vertical member, a first development length portion extending beyond the first vertical member embedded in one of the pair of concrete panels, and a second development length portion extending beyond the second vertical member embedded in an opposite one of the pair;

wherein only the plurality of substantially vertical members and diagonal members traverse between the pair of spaced apart concrete panels to assist the spaced apart concrete panels to resist tension and compression forces applied to the spaced apart concrete without reinforcing concrete in each of the spaced apart concrete panels.

2. The composite truss of claim 1, wherein the vertical members comprise formed metal members.

3. The composite truss of claim 2, wherein the formed metal members comprise at least one of an L cross section, a T cross section, an I cross section, a box cross section, and a circular cross section.

4. The composite truss of claim 1, wherein the first and second end portions of the vertical members comprise respective engagement mechanisms for engaging respective portions of the diagonal member.

5. The composite truss of claim 4, wherein the engagement mechanism comprises geometry for providing a frictional fit and/or a press fit between the engagement mechanism and the portion of the diagonal member.

6. The composite truss of claim 5, wherein the geometry comprises a slot sized to receive a rebar cross section therein with the frictional fit and/or the press fit.

7. The composite truss of claim 1, wherein the vertical member further comprises a spacer attached to at least one end portion of the vertical member for spacing the end portion of the vertical member away from a surface of a form used to cast a concrete panel.

8. The composite truss of claim 1, wherein the diagonal member comprises a rebar.

9. The composite truss of claim 1, wherein the first development length and the second development length portion of the diagonal member each comprise a bend from the substantially exposed diagonal portion so that each development length portion is embedded in the respective one of the pair of concrete panels extending in a near parallel direction with at least one surface of the pair of concrete panels.

10. The composite truss of claim 1, further comprising at least one concrete end bearing beam transversely disposed at an end of the truss.

11. An attached frame for a composite truss including a pair of spaced apart concrete panels, the frame comprising:

a plurality of substantially exposed, substantially vertical members spanning between the pair of spaced apart concrete panels, a first end portion of each vertical member embedded in one of the pair, and a second end portion of each vertical member embedded in an opposite one of the pair; and a diagonal member having a substantially exposed diagonal portion spanning between the first end of a first vertical member and the second end of a second vertical member linearly adjacent to the first vertical member, a first development length portion extending beyond the first vertical member embedded in one of the pair of concrete panels, and a second development length portion extending beyond the second vertical member embedded in an opposite one of the pair;

wherein only the plurality of substantially vertical members and the diagonal member traverse between the pair of spaced apart concrete panels to assist the spaced apart concrete panels to resist tension and compression forces applied to the spaced apart concrete without reinforcing concrete in each of the spaced apart concrete panels.

12. The frame of claim 11, wherein the vertical members comprise formed metal members.

13. The frame of claim 12, wherein the formed metal members comprise at least one of an L cross section, a T cross section, an I cross section, a box cross section, and a circular cross section.

14. The frame of claim 11, wherein the first and second end portions of the vertical members comprise respective engagement mechanisms for engaging respective portions of the diagonal member.

15. The frame of claim 14, wherein the engagement mechanism comprises geometry for providing a frictional fit and/or a press fit between the engagement mechanism and the portion of the diagonal member.

16. The frame of claim 15, wherein the geometry comprises a slot sized to receive a rebar cross section therein with the frictional fit and/or the press fit.

17. The frame of claim 11, wherein the diagonal member comprises a rebar.

18. The frame of claim 11, wherein the first development length and the second development length portion of the diagonal member each comprise bend from the substantially exposed diagonal portion so that each development length portion is embedded in the respective one of the pair of concrete panels extending in a near parallel direction with at least one surface of the pair of concrete panels.

19. The composite truss of claim 4, wherein the engagement mechanisms provides a structure for connecting respective ends of the first and second end portions of the vertical members to respective portions of the diagonal member during assembly of the composite truss wherein the engagement mechanisms do not provide structural support to the composite truss to assist in maintaining its form once assembled.

20. The frame of claim 14, wherein the engagement mechanisms provides a structure for connecting respective ends of the first and second end portions of the vertical members to respective portions of the diagonal member during assembly wherein the engagement mechanisms do not provide structural support to the composite truss to assist in maintaining its form once assembled.

* * * * *